US011083260B2

(12) United States Patent
Hibino

(10) Patent No.: US 11,083,260 B2
(45) Date of Patent: Aug. 10, 2021

(54) UMBRELLA BAG BUNDLE, HOLDING STRUCTURE FOR UMBRELLA BAG BUNDLE, AND BAG OPENING DEVICE

(71) Applicant: Niikura Scales Co., Ltd., Tokyo (JP)

(72) Inventor: Maho Hibino, Tokyo (JP)

(73) Assignee: Niikura Scales Co., Ltd.

( * ) Notice: Subject to any disclaimer, the term of this patent is extended or adjusted under 35 U.S.C. 154(b) by 0 days.

(21) Appl. No.: 16/954,452

(22) PCT Filed: Dec. 26, 2018

(86) PCT No.: PCT/JP2018/047742
§ 371 (c)(1),
(2) Date: Jun. 16, 2020

(87) PCT Pub. No.: WO2019/131714
PCT Pub. Date: Jul. 4, 2019

(65) Prior Publication Data

US 2020/0390205 A1 Dec. 17, 2020

(30) Foreign Application Priority Data

Dec. 26, 2017 (JP) ..... JP2017-248896

(51) Int. Cl.
*A45B 25/24* (2006.01)
*B65B 67/12* (2006.01)

(52) U.S. Cl.
CPC ..... *A45B 25/24* (2013.01); *B65B 67/1211* (2013.01); *B65B 67/1233* (2013.01); *B65B 2067/1294* (2013.01)

(58) Field of Classification Search
CPC ..... B65B 43/00; B65B 43/14; B65B 43/26; B65B 43/28; B65B 43/34; B65B 67/12; B65B 67/1211; B65B 67/1233; B65B 67/1255; B65B 67/1266; B65B 2067/1294; B65D 33/001; A45B 25/24; A47G 25/12

(Continued)

(56) References Cited

U.S. PATENT DOCUMENTS 5,526,631 A * 6/1996 Murakami ..... A45B 25/24 53/390
5,551,219 A * 9/1996 Wei ..... B65B 43/28 53/384.1

(Continued)

FOREIGN PATENT DOCUMENTS

CN 2360339 Y 1/2000
CN 2429051 Y 5/2001

(Continued)

*Primary Examiner* — Stephen F. Gerrity
(74) *Attorney, Agent, or Firm* — Harness, Dickey & Pierce, P.L.C.

(57) ABSTRACT

A bag bundle including bundled umbrella bags each capable of accommodating an umbrella in a bag structure, includes a sheet-like first bag portion, a sheet-like second bag portion that is opposed to the first bag portion and constitutes the bag structure; a sheet-like extension that is extended further upward from a top end of the second bag portion; and an engagement portion that is located on the extension and capable of vertical engagement with the umbrella K. This provides an umbrella bag bundle applicable to various umbrellas without increasing the length of the entire umbrella bag bundle.

15 Claims, 10 Drawing Sheets

(58) Field of Classification Search
USPC ..... 53/384.1; 135/34.2; 383/105
See application file for complete search history.

(56) References Cited

U.S. PATENT DOCUMENTS

| | | | | |
|---|---|---|---|---|
| 5,655,352 | A * | 8/1997 | Murakami | B65B 43/14 53/384.1 |
| 5,797,245 | A * | 8/1998 | Murakami | B65B 43/14 53/384.1 |
| 7,637,081 | B2 * | 12/2009 | Murakami et al. | B65B 67/1266 53/384.1 |
| 2008/0093512 | A1 | 4/2008 | Niikura et al. | |
| 2017/0217643 | A1 * | 8/2017 | Chang et al. | B65D 33/001 |

FOREIGN PATENT DOCUMENTS

| | | | | |
|---|---|---|---|---|
| CN | 106114930 | A | 11/2016 | |
| DE | 3703757 | A1 * | 8/1988 | B65D 33/001 |
| JP | H09-156619 | A | 6/1997 | |
| JP | H09-272519 | A | 10/1997 | |
| JP | H10-007118 | A | 1/1998 | |
| JP | H11-332625 | A | 12/1999 | |
| JP | 2004-209138 | A | 7/2004 | |
| JP | 2007-098178 | A | 4/2007 | |
| JP | 4023552 | B2 | 12/2007 | |
| JP | 2010-000225 | A | 1/2010 | |
| JP | 2014-051312 | A | 3/2014 | |
| JP | 2016-067528 | A | 5/2016 | |
| WO | 2006-057076 | A1 | 6/2006 | |

* cited by examiner

UMBRELLA BAG BUNDLE, HOLDING STRUCTURE FOR UMBRELLA BAG BUNDLE, AND BAG OPENING DEVICE

CROSS REFERENCE TO RELATED APPLICATIONS

This application is a U.S. National Phase application of International Application No. PCT/JP2018/047742, filed on Dec. 26, 2018, which claims priority to Japanese Application No. 2017-248896, filed on Dec. 26, 2017. The entire disclosures of the above applications are incorporated herein by reference.

BACKGROUND

Technical Field

The present invention relates to an umbrella bag bundle that is a stack of umbrella bags for accommodating umbrellas, and the like.

Related Art

For example, in hotels, shops, and the like, umbrella bags made of a synthetic resin and the like for accommodating wet umbrellas are placed near entrances to the shops and the like on a rainy day to prevent clothes, floors, goods, and the like from getting wet by guests and customers carrying around wet umbrellas.

Since insertion of a long umbrella into an umbrella bag is troublesome, a bag opening device for facilitating the insertion of an umbrella into an umbrella bag is often installed as well (see Japanese Patent Application Laid-Open No. Hei. 9-272519). The bag opening device accommodates a bundle of a plurality of umbrella bags, and can mechanically open the openings of the umbrella bags one by one.

Rainwater accumulates gradually in an umbrella bag accommodating a wet umbrella. If the user walks holding a handle of the umbrella, the umbrella bag naturally falls off the umbrella due to the weight of the rainwater. There is an umbrella bag having a belt-like belt formed in a width direction near its opening to prevent falling. If the umbrella bag starts to fall, the belt autonomously catches on the ends of the umbrella ribs or the rim of the canopy to suppress falling of the umbrella bag (see Japanese Patent No. 4023552).

Umbrellas have diversified in recent years. To withstand a hard rain, umbrellas with a longer shaft and a wider canopy area are increasing. In the case of such a long umbrella, the ends (tips) of the ribs and the vicinity of the outer rim of the canopy can stick out of the opening of an umbrella bag.

As a result, the umbrella bag is likely to naturally fall off the umbrella due to the own weight of the rainwater since the belt for fall prevention formed near the opening of the umbrella bag does not reach the ends of the ribs or the rim of the canopy.

On the other hand, simply changing the size of the umbrella bag to be longer has had a problem that the umbrella bag bundle fails to fit in the accommodation space of an umbrella bag bundle in existing bag opening devices.

The present invention has been achieved in view of such circumstances, and is intended to provide an umbrella bag bundle and the like applicable to various umbrellas without increasing the length of the entire umbrella bag bundle.

SUMMARY

To achieve the foregoing object, the present invention provides an umbrella bag bundle including bundled umbrella bags each capable of accommodating an umbrella in a bag structure, wherein when a longitudinal direction of the umbrella accommodated in the bag structure is defined as a vertical direction and a direction orthogonal to the vertical direction is defined as a width direction, the umbrella bag includes: a sheet-like first bag portion; a sheet-like second bag portion that is opposed to the first bag portion and constitutes the bag structure having an opening at a top end in the vertical direction in cooperation with the first bag portion; a sheet-like extension that is extended further upward from a top end of the second bag portion; and an engagement portion that is located on the extension and capable of vertical engagement with the umbrella.

The foregoing umbrella bag is characterized in that the engagement portion is capable of engagement with a side surface of the umbrella inserted in the bag structure via the opening, the side surface facing to the extension.

The foregoing umbrella bag is characterized in that: a hole for allowing the umbrella bag to be suspended is formed in the extension; and the engagement portion is located on the extension 30 within a range of ¾ downward from a top edge of the hole.

The foregoing umbrella bag is characterized in that the engagement portion is located on the extension 30 within a range of ⅔ downward from the top edge of the hole.

The foregoing umbrella bag is characterized in that the engagement portion is located on the extension 30 within a range of ½ downward from the top edge of the hole.

The foregoing umbrella bag is characterized in that the engagement portion is located on the extension 30 within a range of ¾ downward from a top end of the extension.

The foregoing umbrella bag is characterized in that the engagement portion is located on the extension 30 within a range of ⅔ downward from the top end of the extension.

The foregoing umbrella bag is characterized in that the engagement portion is located on the extension 30 within a range of ½ downward from the top end of the extension.

The foregoing umbrella bag is characterized in that: the umbrella bag is installed on a bag opening device that inserts an opening plate into the opening and opens the opening; and the extension secures a slide area for an end of the bag opening plate to abut against and to slide over up to the opening, the slide area being located between the opening and the engagement portion.

The foregoing umbrella bag is characterized in that the engagement portion is located on the extension at a position 10 mm or more above and away from a bottom end of the extension.

The foregoing umbrella bag is characterized in that the engagement portion is located on the extension at a position 20 mm or more above and away from the bottom end of the extension.

The foregoing umbrella bag is characterized in that the engagement portion is located on the extension at a position 30 mm or more above and away from the bottom end of the extension.

The foregoing umbrella bag is characterized in that: the extension includes a recess that is recessed inward in the width direction from an end in the width direction; and the engagement portion is located on the extension at a position off the recess upward or to a possible side.

The foregoing umbrella bag is characterized in that: a hole for allowing the umbrella bag to be suspended is formed in the extension; and the engagement portion is located on the extension below the hole.

The foregoing umbrella bag is characterized in that: a separation line for separating the umbrella bag is formed in the extension, the separation line extending in the width direction; and the engagement portion is located on the extension below the separation line.

The foregoing umbrella bag is characterized in that the engagement portion includes an engagement edge extending in the width direction of the extension.

The foregoing umbrella bag is characterized in that the engagement portion is a belt-like member extending in the width direction of the extension.

The foregoing umbrella bag is characterized in that the belt-like member has a belt width of 20 mm or less.

The foregoing umbrella bag is characterized in that the belt-like member has a belt width of 10 mm or less.

The foregoing umbrella bag is characterized in that the engagement portion is a slit or an opening extending in the width direction of the extension.

The foregoing umbrella bag is characterized by including a lower engagement portion that is located below and at a distance from the engagement portion and is capable of vertical engagement with the umbrella.

The foregoing umbrella bag is characterized in that the lower engagement portion is located near the opening of the bag structure.

The foregoing umbrella bag is characterized in that the lower engagement portion is located inside the bag structure.

The foregoing umbrella bag is characterized in that the lower engagement portion is a belt-like member extending in the width direction.

To achieve the foregoing object, the present invention provides a holding structure for the umbrella bag bundle according to any one of the foregoing paragraphs, the holding structure including a holding plate capable of abutting against a flat surface of the extension on a side closer to the first bag portion, wherein the holding plate is located above the opening and covers the engagement portion.

To achieve the foregoing object, the present invention provides a bag opening device configured to open the opening of the umbrella bag in the umbrella bag bundle according to any one of the foregoing paragraphs, the bag opening device including a holding structure configured to hold the umbrella bag bundle, an opening plate that is to be inserted into the opening to open the opening, and a moving mechanism configured to bring an end of the bag opening plate into contact with the extension above the opening and below the engagement portion and slide the end of the bag opening plate up to the opening.

Advantageous Effects of Invention

According to the foregoing means, an umbrella bag applicable to various umbrellas can be obtained without increasing the length of the entire umbrella bag bundle. Moreover, the holding structure for an umbrella bag bundle can suppress accommodation failures in accommodating an umbrella into an umbrella bag. Furthermore, the bag opening device according to the present means can appropriately open the opening of an umbrella bag having a fall prevention function.

DETAILED DESCRIPTION

Hereinafter, an embodiment of the present invention will be described with reference to the accompanying drawing.

Overall Configuration

Figure 1A:
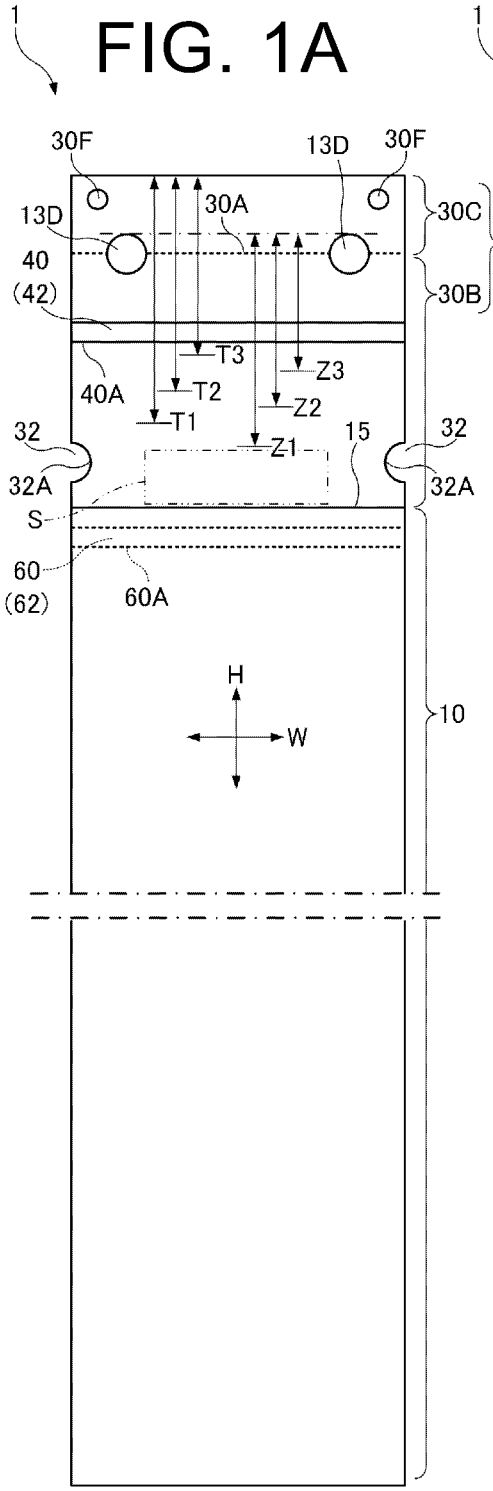
FIG. 1A is a front view of an umbrella bag constituting an umbrella bag bundle according to an embodiment of the present invention.
Figure 1B:
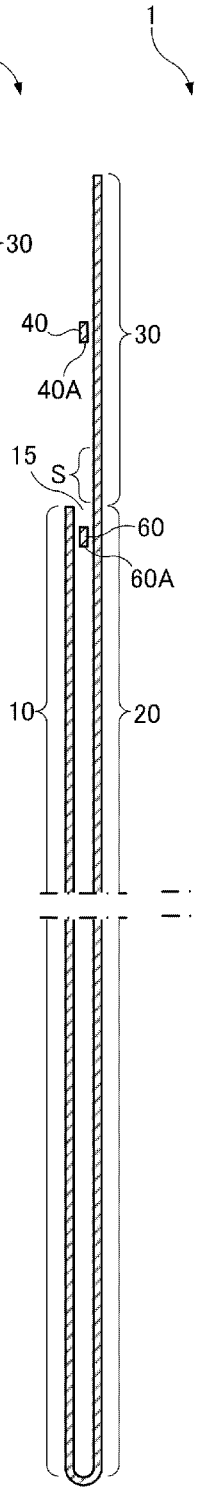
FIG. 1B is a cross-sectional side view of the same.
Figure 1C:
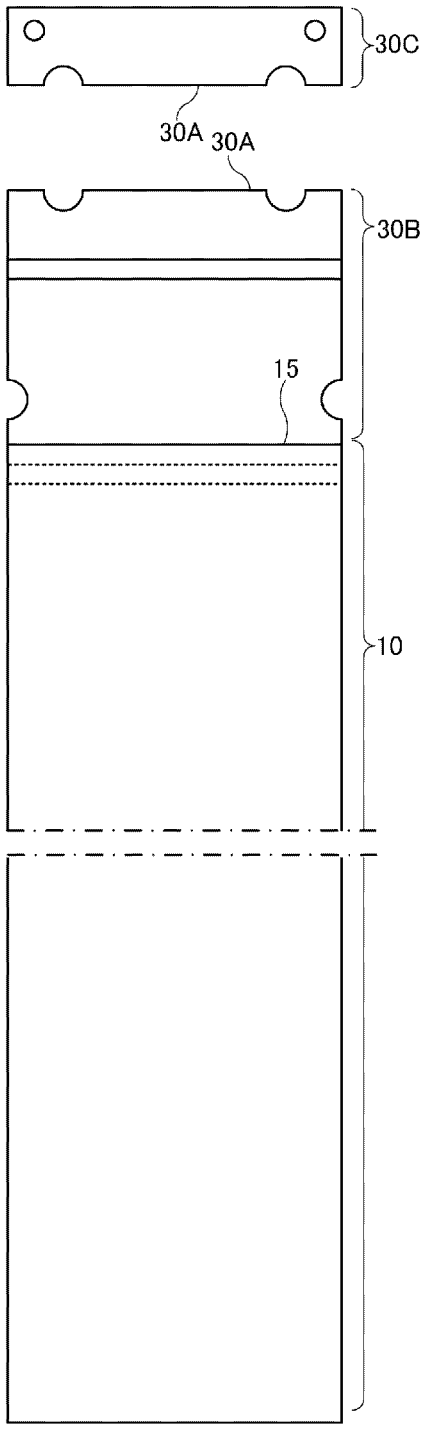
FIG. 1C is a front view in a state where the umbrella bag is separated along a separation line.

An overall configuration of an umbrella bag 1 constituting an umbrella bag bundle according to the embodiment of the present invention will be described with reference to FIGS. 1A-1C. As illustrated in FIGS. 1A-1C, the umbrella bag 1 includes a first bag portion 10, a second bag portion 20, an extension 30, a first engagement portion 40 (upper engagement portion), and a second engagement portion 60 (lower engagement portion). In the following description, the longitudinal direction of the umbrella bag 1 is defined as a vertical direction (with an opening side up and a bottom side down) H, and a direction orthogonal to the longitudinal direction as a width direction W. This umbrella bag 1 indicates a state before bundled up or a state before separated from the umbrella bag bundle.

First Bag Portion

The first bag portion 10 constitutes a front-side surface of a bag structure configured to accommodate an umbrella in the umbrella bag 1. For example, the first bag portion 10 is made of a rectangular, or more specifically, vertically extending belt-like soft sheet. Examples of the material of the soft sheet include a thermoplastic resin such as polypropylene. However, this is not restrictive, and other synthetic resins may be used. The description of the soft sheet also applies to the following.

Second Bag Portion

The second bag portion 20 constitutes a rear-side surface of the bag structure of the umbrella bag 1. For example, the second bag portion 20 is made of a rectangular, or more specifically, belt-like soft sheet having substantially the same shape and substantially the same size as those of the first bag portion 10.

Bag Structure

The edges of the first bag portion 10 and the second bag portion 20 at both ends in the width direction or vicinities thereof are joined to each other. The bottom edges of the first bag portion 10 and the second bag portion 20 or vicinities thereof are also joined to each other. As a result, the first bag portion 10 and the second bag portion 20 constitute a bag structure. The top edges of the first bag portion 10 and the second bag portion 20 are not joined to each other and form an opening 15 of the bag structure. The opening 15 extends across both ends of the first bag portion 10 and the second bag portion 20 in the width direction, whereby position of the opening 15 in the vertical direction is uniquely determined.

In a cutting operation by a cutter that defines the outline of the first bag portion 10 and the second bag portion 20, the peripheries of the first bag portion 10 and the second bag portion 20 are welded (fused) to each other by applying heat to the cutter at the same time. However, the manufacturing technique is not limited thereto, and the first bag portion 10 and the second bag portion 20 may be joined by other methods such as adhesive bonding. The edges of the first bag portion 10 and the second bag portion 20 at both ends in the width direction or the vicinities thereof, and the bottom edges or the vicinities thereof, may be joined to each other at least in part. In view of preventing leakage of rainwater, the entire edges are desirably joined.

Extension

The extension 30 is extended further upward from the top edge of the second bag portion 20. For example, the extension 30 is made of a rectangular soft sheet having substantially the same length in the width direction as that of the second bag portion 20 and a length smaller in the vertical direction than that of the second bag portion 20. The extension 30 and the second bag portion 20 may be made of a single soft sheet or formed by joining respective separate soft sheets. The length in the vertical direction of the extension 30 is preferably 70 mm or more and 150 mm or less, and is desirably set to 80 mm to 100 mm. In the present embodiment, the length in the vertical direction is 90 mm.

A separation line 30A extending in the width direction is formed in the middle of the extension 30 in the vertical direction. With the separation line 30A as a border, the extension 30 is separated into a near side extension 30B closer to the opening 15 of the bag structure and a far side extension 30C farther from the opening 15. For example, such a separation line 30A is formed by a perforated cutting line. The near side extension 30B is continuous with the top end of the second bag portion 20 in the vertical direction of the extension 30. The far side extension 30C is continuous with the top end of the near side extension 30B.

The far side extension 30C has engagement holes 13D. For example, engagement bars of a bag holding structure for umbrella bags to be suspended and held on (not illustrated) are inserted into the engagement holes 13D, whereby the umbrella bag 1 is held in a suspended manner. In the present embodiment, the engagement holes 13D are formed across the border (separation line 30A) between the far side extension 30C and the near side extension 30B.

A pair of recesses 32 recessed inward in the width direction from both ends in the width direction are formed in the extension 30. The recesses 32 are shaped like so-called semi-arc cutouts. Since the pair of recesses 32 are formed at the same position in the vertical direction, the extension 30 has a minimum width near the pair of recesses 32. Base portions 32A of the recesses 32 are set above the bottom end (opening 15) of the extension 30. With such a configuration, stress concentrates on the base portions 32A when tension in the vertical direction acts on the umbrella bag 1. In other words, the extension 30 and the first and second bag portions 10 and 20 are positively prevented from stress concentration on other locations than the recesses 32. In particular, if stress concentrates on both ends of the opening 15, the opening 15 is likely to tear so that the top ends of the first bag portion 10 and the second bag portion 20 get away from each other. The recesses 32 play the role of suppressing a tear of the opening 15.

First Engagement Portion (Upper Engagement Portion)

A first engagement portion 40 capable of vertical engagement with an umbrella is formed on the extension 30. The first engagement portion 40 includes a belt-like member 42 extending in the width direction. The first engagement portion 40 is characterized in that, as illustrated in FIG. 2, when the belt-like member 42 bends, the belt-like member 42 can be engaged with a side surface facing toward the extension 30 of an umbrella K inserted into the bag structure via the opening 15. The belt-like member 42 has a length (length in the width direction) substantially the same as the width of the extension 30. Both longitudinal ends of the belt-like member 42 are welded to or near the edges of the extension 30 at both ends in the width direction. Methods other than welding, such as adhesive bonding, may be used to join the ends. The belt-like member 42 is preferably a member independent from the first bag portion 10. The reason is to prevent the belt-like member 42 from moving together with a bag opening operation of the first bag portion 10. In the present embodiment, both longitudinal ends of the belt-like member 42 are welded to both ends of the extension 30.

The bottom edge of the belt-like member 42 forms a first engagement edge 40A extending in the width direction. As will be described later, this engagement edge 40A serves as an edge to be engaged with an umbrella and prevent falling when the umbrella bag 1 starts to naturally fall off the umbrella.

The belt-like member 42 preferably has a belt width (length in the vertical direction) of 20 mm or less, more desirably 10 mm or less. In the present embodiment, the belt width is 5 mm. The smaller the belt width of the belt-like member 42 is, the softer the belt-like member 42 itself is and the more likely the belt-like member 42 is to get away (be protruded) from the extension 30 except both ends that are the junctions. Meanwhile, the belt width is set to 2 mm or more. The reason is that too thin a belt-like member 42 is easy to break due to insufficient strength. If the belt-like member 42 has too large a belt width, the belt-like member 42 electrostatically adheres to the extension 30, or is less likely to get away from the extension 30 due to increased rigidity.

For the purpose of engagement with a long umbrella, the first engagement portion 40 is desirably located at as high a position on the umbrella bag 1 as possible. The belt-like member 42 of the first engagement portion 40 is thus preferably located within the range of an area T1 that is ¾ of the extension 30 downward from the top end. The first engagement portion 40 is more desirably located within the range of an area T2 that is ⅔ downward from the top end. The first engagement portion 40 is even more desirably located within the range of an area T3 that is ½ downward from the top end. In the present embodiment, the first engagement portion 40 is formed within the range of the range T3. In terms of specific dimensions, the belt-like member 42 of the first engagement portion 40 is preferably located within the range of 30 mm to 70 mm downward from the top end of the extension 30. The first engagement portion 40 is more desirably located within the range of 40 mm to 55 mm downward from the top end.

Similarly, for the purpose of engagement with a long umbrella, the first engagement portion 40 is desirably located at as high a position on the umbrella bag 1 as possible. The belt-like member 42 of the first engagement portion 40 is thus preferably located on the extension 30 within the range of an area Z1 that is ¾ downward from the upper edges of the engagement holes 13D. The first engagement portion 40 is more desirably located within the range of an area Z2 that is ⅔ downward from the upper edges of the engagement holes 13D. The first engagement portion 40 is even more desirably located within the range of an area Z3 that is ½ downward from the upper edges of the engagement holes 13D. In the present embodiment, the first engagement portion 40 is formed within the range of the range Z3. In terms of specific dimensions, the belt-like member 42 of the first engagement portion 40 is preferably located within the range of 15 mm to 55 mm downward from the upper edges of the engagement holes 13D. The first engagement portion 40 is even more desirably located within the range of 25 mm to 40 mm downward from the top ends.

A description will be given from another point of view. The first engagement edge 40A of the belt-like member 42 of the first engagement portion 40 is desirably as much above and away from the bottom end of the extension 30 (i.e., the opening 15) as possible. The first engagement edge 40A of the first engagement portion 40 is thus preferably located at a position 10 mm or more above and away from the opening 15, more desirably at a position 20 mm or more away, even more desirably at a position 30 mm or more away.

Moreover, the first engagement portion 40 is located on the extension 30 below the engagement holes 13D. The reason is that if the first engagement portion 40 overlaps the engagement holes 13D, the belt-like member 42 can interfere with and be broken by the engagement bars inserted through the engagement holes 13D during suspension. To reduce the possibility for the belt-like member 42 to curve and overlap the engagement holes 13D, the upper edge of the belt-like member 42 is preferably located at a position 5 mm or more below and away from the lower edges of the engagement holes 13D. The upper edge is desirably located 10 mm or more away, even more desirably 15 mm or more away.

Furthermore, the first engagement portion 40 is located on the extension 30 below the separation line 30A. The reason is that if the first engagement portion 40 overlaps the separation line 30A, the belt-like member 42 can be broken upon separation. When the umbrella bag 1 is separated at the separation line 30A as illustrated in FIG. 1C, the vicinity of the top edge (separation line 30A) of the near side extension 30B can decrease in rigidity and bend backward (in a direction away from the umbrella). The first engagement edge 40A of the first engagement portion 40 is therefore preferably below and away from the separation line 30A. Specifically, the first engagement edge 40A is preferably 5 mm or more below and away from the separation line 30A. The first engagement edge 40A is more desirably 10 mm or more away, even more desirably 15 mm or more away.

In view of setting the umbrella bag 1 into a bag opening device 200 (see FIGS. 3 and 4), the extension 30 secures a slide area S for an end 210A of an opening plate 210 of the bag opening device 200 to abut against and slide over up to the opening 15. More specifically, the slide area S is an area that starts at the opening 15 and has a predetermined distance upward. For example, the slide area S preferably has a length of 10 mm or more, desirably 20 mm or more, more desirably 30 mm or more, in the vertical direction. The first engagement portion 40 is thus located above the slide area S. This prevents the first engagement portion 40 from interfering with the end 210A of the opening plate 210, and enables a smooth bag opening operation by the bag opening device 200. By contrast, a second engagement portion 60 to be described later is configured to be engaged with the end 210A of the opening plate 210 and positively distanced from the second bag portion 20. In other words, the first engagement portion 40 and the second engagement portion 60 have a structure of holding the umbrella from both sides at vertically different positions. The second engagement portion 60 may be positioned on the same side of the umbrella as the first engagement portion 40 is.

Furthermore, the first engagement portion 40 is located at a position off the pair of recesses 32 of the extension 30 upward or downward. According to the above configuration, when tension in the vertical direction acts on the extension 30, stress is concentrated at both ends of the first engagement portion 40, and the first engagement portion 40 can be prevented from being torn from the extension 30. In the present embodiment, the first engagement portion 40 is located above the recesses 32.

Second Engagement Portion (Lower Engagement Portion)

The second engagement portion 60 capable of vertical engagement with the umbrella is formed below the first engagement portion 40. The first engagement portion 60 includes a belt-like member 62 extending in the width direction. The belt-like member 62 has a length (length in the width direction) substantially the same as the width of the first bag portion 10 and the second bag portion 20. Both longitudinal ends of the belt-like member 62 are welded to or near the edges on both ends in the width direction inside the bag structure formed by the first bag portion 10 and the second bag portion 20.

The lower edge of the belt-like member 62 forms a second engagement edge 60A extending in the width direction. As will be described later, the second engagement edge 60A serves as an edge to be engaged with an umbrella and prevents falling when the umbrella bag 1 starts to naturally fall off the umbrella.

The belt-like member 62 preferably has a belt width (length in the vertical direction) of 20 mm or less, more desirably 10 mm or less, and in the present embodiment, 5 mm. The smaller the belt width of the belt-like member 62 is, the softer the belt-like member 62 itself is and the more likely the belt-like member 62 is to get away from the inner periphery of the bag structure except both ends that are the junctions. Meanwhile, the belt width is set to 2 mm or more. Too thin a belt-like member 62 is easy to break due to insufficient strength. If the belt-like member 62 has too large a belt width, the belt-like member 62 electrostatically adheres to the first or second bag portion 10 or 20, or is less likely to get away from the inner periphery of the bag structure due to increased rigidity.

Figure 10A:
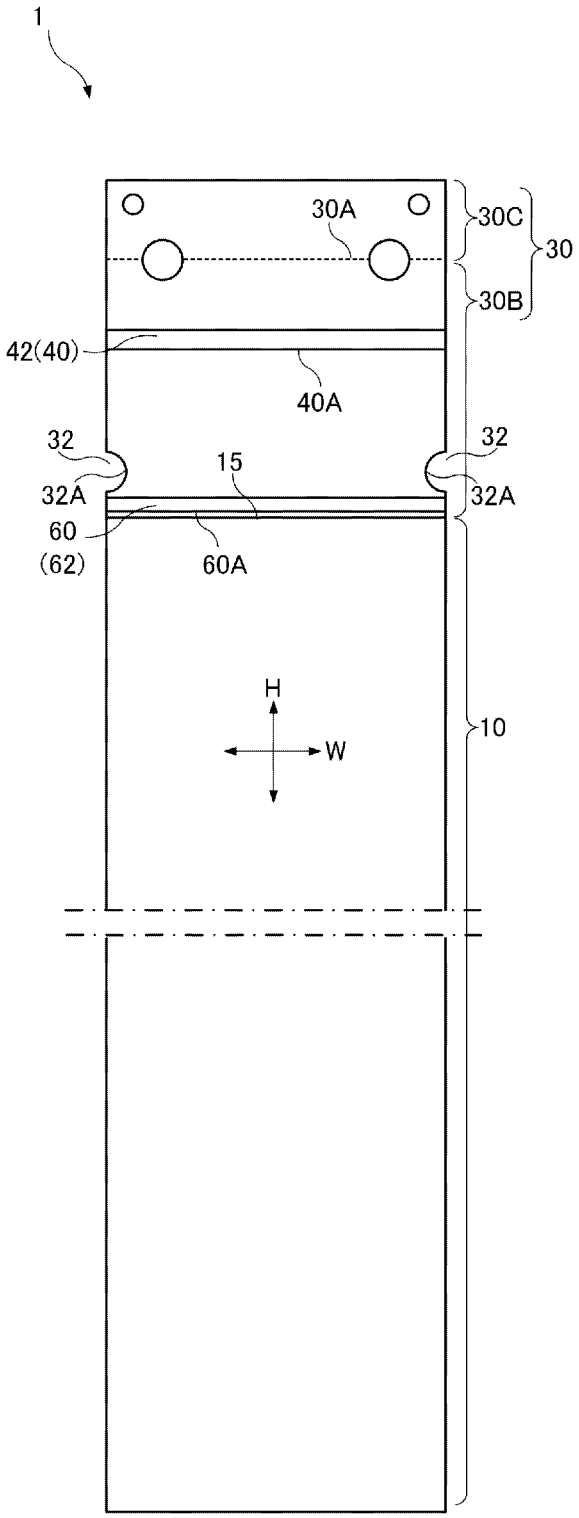
FIGS. 10A and 10B are a front view and a cross-sectional side view, respectively, illustrating a modified example of the umbrella bag.
Figure 10B:
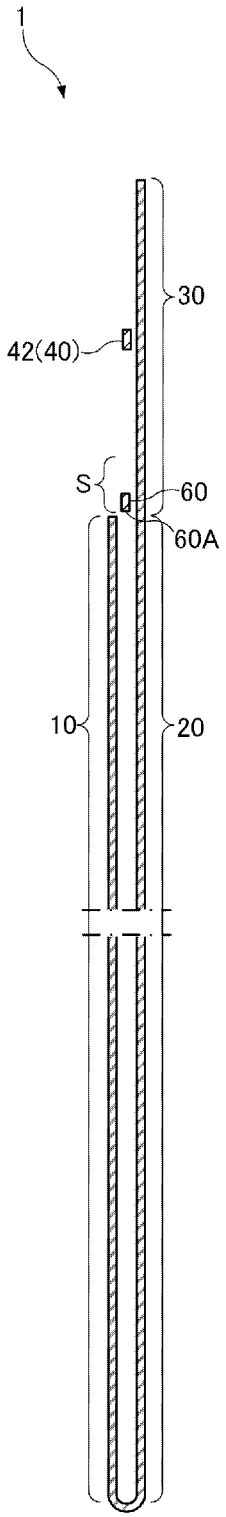

The second engagement portion 60 is preferably located near the opening 15 of the bag structure. Specifically, the second engagement edge 60A is located within the range of 40 mm downward from the opening 15. As illustrated in FIGS. 10A and 10B, the second engagement portion 60 may be located on the extension 30 at a position close to the opening 15. In other words, the position of the second engagement edge 60A may coincide with or be situated above the opening 15. Note that if the second engagement portion 60 below the first engagement portion 40 is 20 mm or more above and away from the opening 15, the possibility for the second engagement portion 60 to be cut by the opening plate 210 of the bag opening device 200 increases when the opening 15 is opened.

The second engagement portion 60 is located at a position off the recesses 32 downward. According to the above configuration, when tension in the vertical direction acts on the second bag portion 20 and the extension 30, stress is concentrated at both ends of the second engagement portion 60, and the second engagement portion 60 can be prevented from being torn from the bag structure.

Operation of Umbrella Bag

Figure 2A:
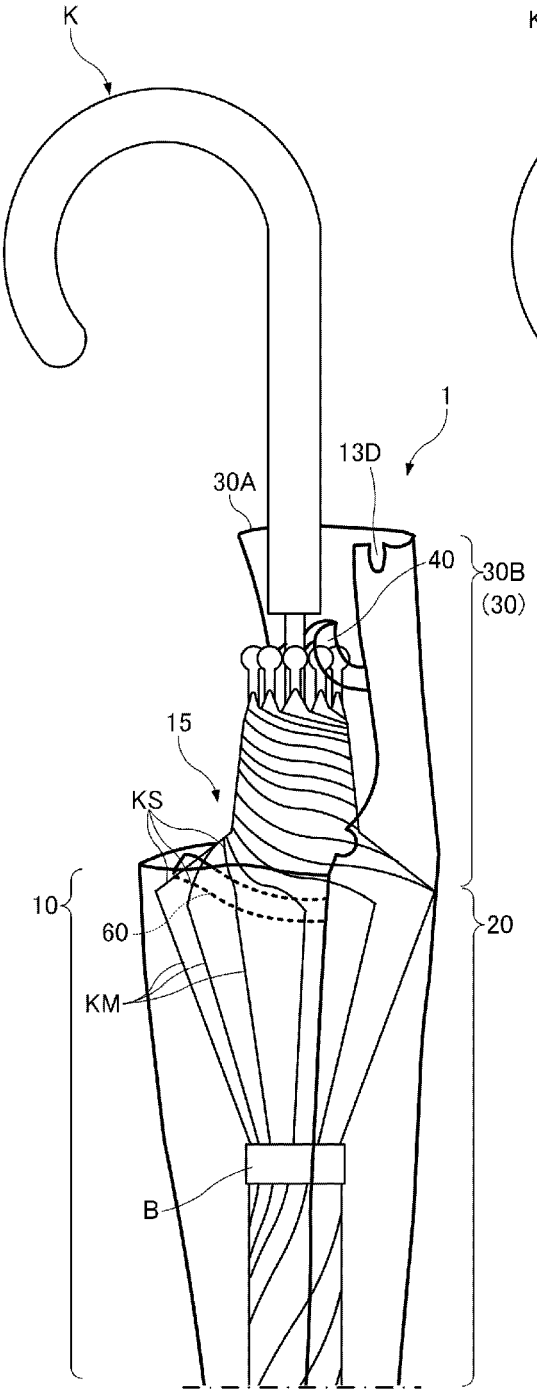
FIG. 2A is a partial enlarged view illustrating a state where a short umbrella is accommodated in the umbrella bag.

Next, an operation of the umbrella bag 1 will be described with reference to FIG. 2. FIG. 2A illustrates a state where an umbrella K having a short (or normal) shaft is accommodated in the umbrella bag 1. Here, the umbrella bag 1 is in a state after separation along the separation line 30A. In inserting the umbrella K into the bag structure from the opening 15 of the umbrella bag 1, the second engagement portion 60 is brought close to the first bag portion 10. In other words, when the first bag portion 10 is moved away from the integrated second bag portion 20 and extension 30 to open the opening 15, the second engagement portion 60 is also moved away from the second bag portion 20. As a result, the umbrella K inserted through the opening 15 lies between the second engagement portion 60 and the second bag portion 20. Since part of a rim KS of the canopy (in particular, the rim KS near the ends of folds KM when the canopy is folded) is accommodated inside the bag structure, the second engagement portion 60 is vertically engaged with the rim KS.

The first engagement portion 40 located on the extension 30 is positioned on a side closer to the extension 30 than the umbrella K accommodated in the bag structure is. When the bag structure is spread out by the umbrella K, the first bag portion 10 and the second bag portion 20 form a cylindrical shape, and the extension 30 takes a semicylindrical shape as well. The belt-like member 42 (the second engaging portion 60) welded to both ends of the extension 30 in the width direction sags naturally and is thereby protruded forward away from the second engagement portion 60 to approach the shaft of the umbrella K, the ends of the ribs, and the rim of the canopy. This brings the umbrella K and the second engagement portion 60 into a state capable of vertical engagement. In particular, the first engagement portion 40 is located at a position above and away from the opening 15, and is thus likely to be engaged with the vicinity of the ends (tips) of the ribs of the umbrella K. As can be seen, since the first engagement portion 40 preferably bends in front of the extension 30, the first engagement portion 40 is preferably joined to the extension 30 only near both ends in the width direction.

The first engagement unit 40 may be deliberately moved away from the extension 20 so that the umbrella K is inserted into between the first engagement portion 40 and the extension 20. However, such an operation is not implemented in the case discussed here. If the bag opening device 200 to be described later is used, the first engagement portion 40 located above is not easy to be opened simultaneously with the opening 15. In addition, the belt-like member 42 has relatively low strength since the belt width of the belt-like member 42 is reduced to facilitate the forward bend of the belt-like member 42 from the extension 30. The insertion of the umbrella K into between the belt-like member 42 and the first bag portion 10 can thus easily break the belt-like member 42. It will be understood that the belt width may be increased to increase the strength, so that the umbrella K can be inserted into between the first engagement portion 40 and the extension 20.

Figure 2B:
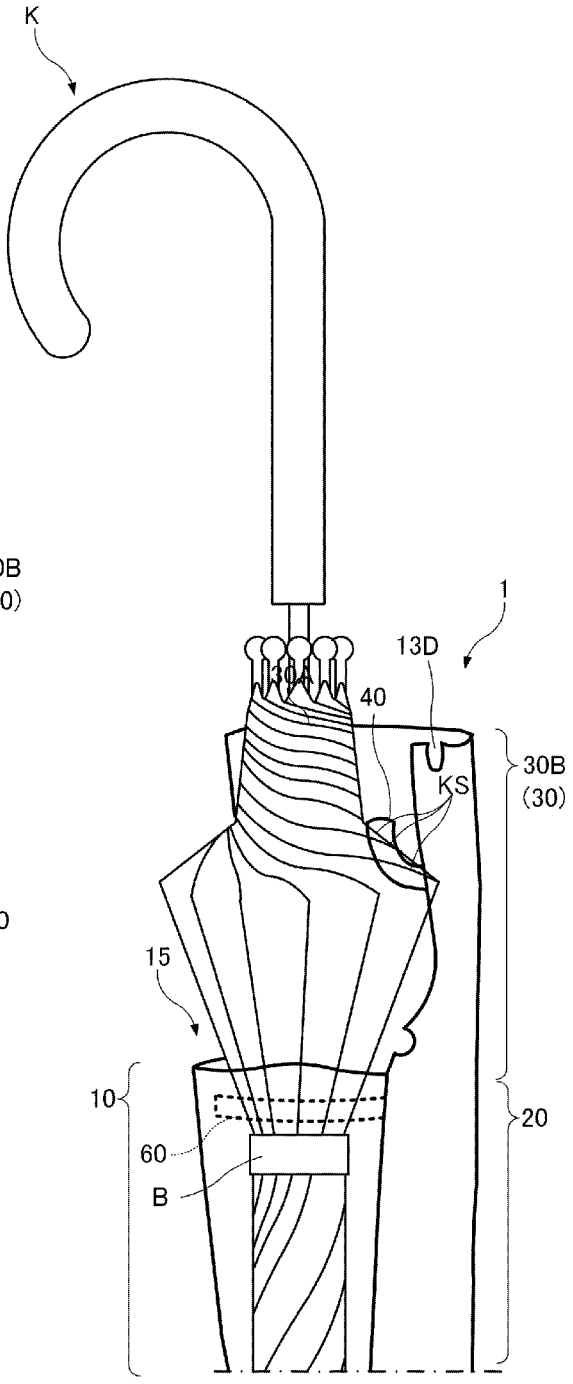
FIG. 2B is an enlarged view illustrating a state where a long umbrella is accommodated in the umbrella bag.

FIG. 2B illustrates a state where a long umbrella K with a relatively long ferrule or shaft is accommodated in the umbrella bag 1. The umbrella K inserted through the opening 15 lies between the second engagement portion 60 and the second bag portion 20. The long umbrella K also has a large canopy radius, and the rim KS sticks out above the bag structure. The second engagement portion 60 is therefore hardly engaged with the umbrella K, or can be engaged with a band B binding the canopy of the umbrella K.

The first engagement portion 40 located on the extension 30 is positioned closer to the extension 30 than the umbrella K accommodated in the bag structure is, and sags naturally to be protruded forward away from the second engagement portion 60. This brings the first engagement portion 40 into a state capable of vertical engagement with the rim KS of the canopy sticking out above the bag structure. In particular, the first engagement portion 40 is likely to be engaged with the vicinity of the rim KS of the long umbrella K since the first engagement portion 40 is located at a position above and away from the opening 15.

As described above, according to the umbrella bag 1 of the present embodiment, if the umbrella K is a short one, both the first engagement portion 40 and the second engagement portion 60 are vertically engaged with the umbrella K as illustrated in FIG. 2A. The natural fall of the umbrella bag 1 can thus be highly suppressed. In addition, since the first engagement portion 40 and the second engagement portion 60 are vertically separated, the first engagement portion 40 and the second engagement portion 60 can be engaged with various areas of the umbrella K. On the other hand, if the umbrella K is a long one, the first engagement portion 40 can be engaged with the canopy sticking out of the bag structure as illustrated in FIG. 2B. This can suppress the natural fall of the umbrella bag 1. In other words, the umbrella bag 1 is applicable to various types of umbrellas K.

Holding Structure

Figure 3A:
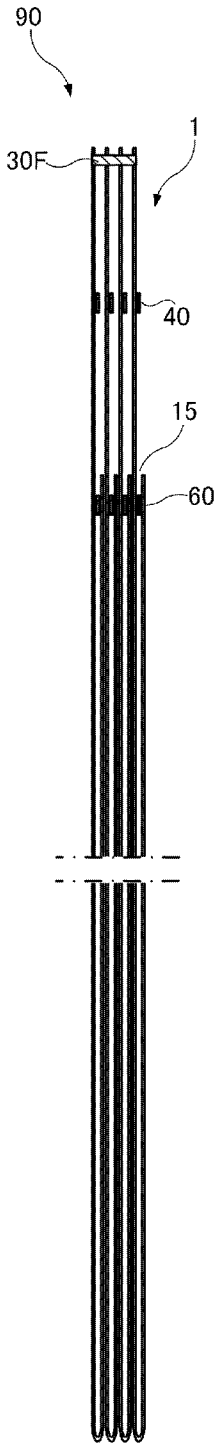
FIG. 3A is a cross-sectional side view illustrating an umbrella bag bundle that is a bundle of a plurality of umbrella bags.

Next, a holding structure 100 for umbrella bags 1 and the bag opening device 200 to which the holding structure 100 is applied will be described with reference to FIGS. 3A and 3B and the subsequent diagrams. As illustrated in FIG. 3A, a plurality of umbrella bags 1 are stacked and bound together in the stacking direction by using the far side extensions 30C of the extensions 30 (i.e., the portions above the separation lines 30A). These binding portions 30F are, as illustrated in FIGS. 1A-1C, a pair of welded portions formed near both ends in the width direction. As employed herein, the plurality of umbrella bags 1 in the stacked state will be referred to as an "umbrella bag bundle 90". For convenience of description, FIG. 3A illustrates a state where the sheets have a large thickness, the first bag portions 10 and the second bag portions 20 are apart from each other, and the first engagement portions 40 are apart from the extensions 30 as well. However, actual umbrella bags 1 are made of extremely thin sheet members of around 5 μm to 20 μm and all the sheets are in close contact with each other when they are in the stacked state.

Figure 4A:
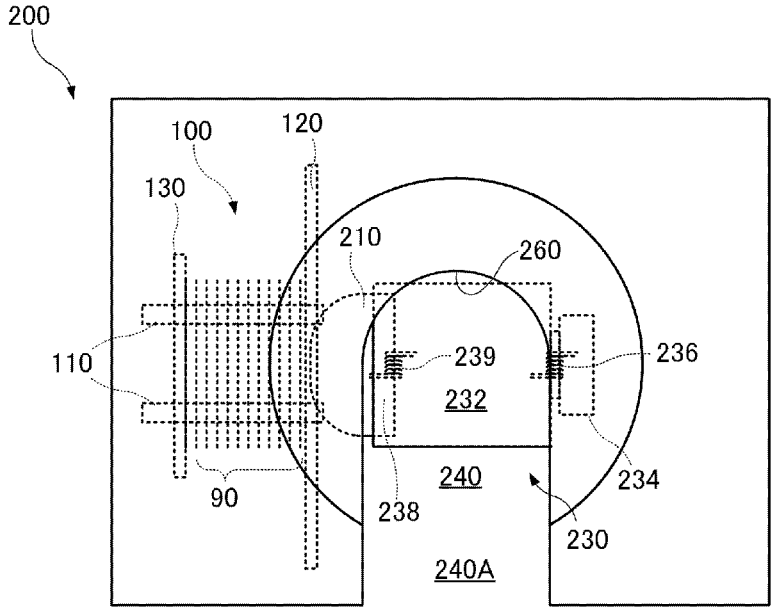
FIG. 4A is a plan view of the bag opening device.

As illustrated in FIG. 4A, the holding structure 100 includes a pair of engagement bars 110 inserted into a pair of engagement holes 13D in the umbrella bag bundle 90, a front-side holding plate 120 capable of abutting against the umbrella bag 1 located at the foremost position in the umbrella bag bundle 90, and a rear-side holding plate 130 capable of abutting against the umbrella bag 1 located at the rearmost position in the umbrella bag bundle 90. Although not illustrated in particular, the rear-side holding plate 130 is biased to the front side by a leaf spring, a coil spring, or the like.

Figure 4B:
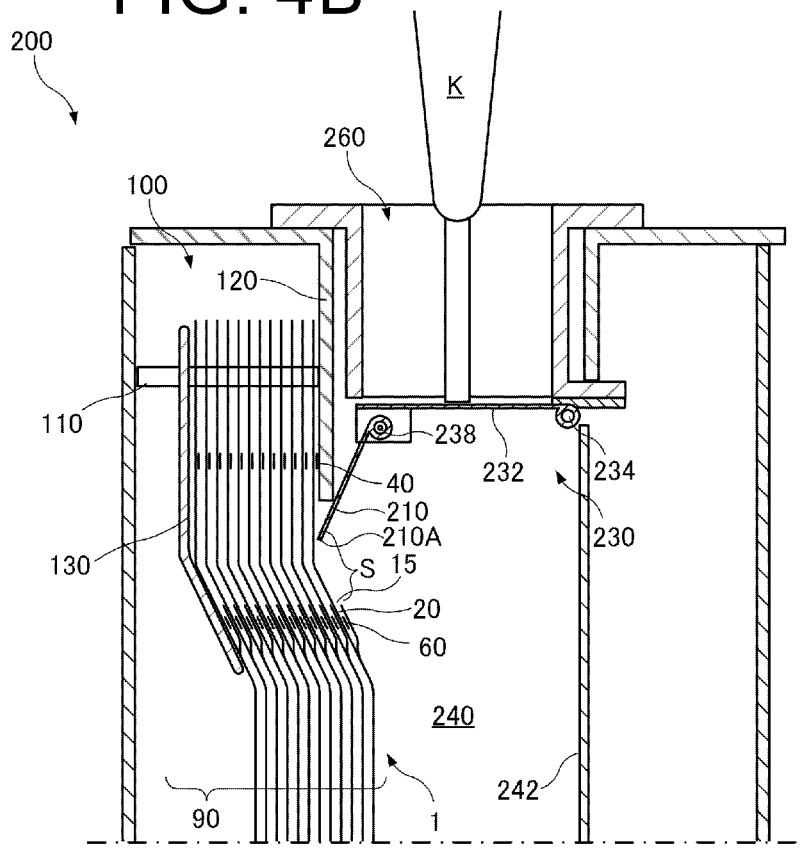
FIG. 4B is an enlarged cross-sectional side view of the bag opening device.

As illustrated in FIG. 4B, the front-side holding plate 120 abuts against the front side of the extension 30 and located above the opening 15 to cover at least part (here, all) of the first engagement portion 40. In other words, the front-side holding plate 120 covers part (at least the vicinity of the center in the width direction) of the belt-like member 42 of the first engagement portion 40 while exposing the opening 15. Holding the umbrella bag bundle 90 in such a manner can prevent the situation where an umbrella K catches on the first engagement portion 40 and breaks the first engagement portion 40 in the process of inserting the umbrella K into the opening 15. On the other hand, when the umbrella K is inserted and then the foremost umbrella bag 1 is separated at the separation line 30A, the first engagement portion 40 is exposed and, as illustrated in FIG. 2, becomes capable of vertical engagement with the umbrella K.

Bag Opening Device

Figure 3B:
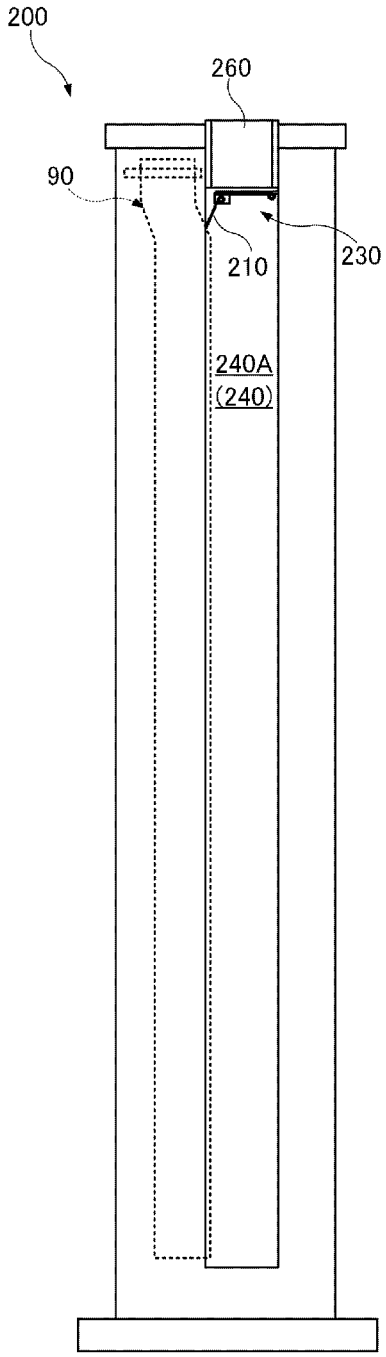
FIG. 3B is a side view illustrating an overall configuration of a bag opening device.

As illustrated in FIG. 3B, the bag opening device 200 including the holding structure 100 includes, on the front side of the umbrella bag bundle 90, an umbrella insertion space 240 that is to be a cylindrical space extending in the vertical direction along the longitudinal direction of the umbrella bags 1, an umbrella insertion port 260 located above the umbrella insertion space 240, the opening plate 210 to be inserted into the opening 15 of an umbrella bag 1 and open the opening 15, and a moving mechanism 230 configured to move (swing) the opening plate 210. As illustrated in FIG. 4B, the umbrella insertion space 240 is a cylindrical space interposed between the vertically-extending umbrella bag bundle 90 and a guide surface 242 opposed to the umbrella bag bundle 90 at a distance. A vertically-extending slit 240A is secured between the umbrella bag bundle 90 and the guide surface 242, on one side in the width direction. Using the slit 240A, the umbrella K accommodated in the umbrella bag 1 can be pulled out in a direction perpendicular to the axis (the width direction of the umbrella bag 1). That is, the umbrella insertion space 240 does not have a perfectly cylindrical shape but a partially cylindrical shape with an open side.

As illustrated in FIGS. 4A and 4B, the moving mechanism 230 includes a swing plate 232 that is located under the umbrella insertion port 260 and closes the umbrella insertion port 260, a base-side hinge 234 that is fixed to near the umbrella insertion port 260 and makes the swing plate 232 vertically swing, and a base-side torsion spring 236 that biases the swing plate 232 upward to maintain the swing plate 232 in the position of closing the umbrella insertion port 260. As a result, the swing plate 232 can be swung downward to open the umbrella insertion port 260 against the force of the base-side torsion spring 236. The moving mechanism 230 further includes an end-side hinge 238 that is located on the end (swing end) side of the swing plate 232 and vertically swingably holds the opening plate 210, and an end-side torsion spring 239 that is located on the end-side hinge 238 and biases the swing plate 232 toward the umbrella bag 1. When the umbrella K is inserted downward through the umbrella insertion port 260, the swing plate 232 is pushed down by the ferrule of the umbrella K against the biasing force of the base-side torsion spring 236 (see FIGS. 5A-5C). As a result, the opening plate 210 slides down as the swing plate 232 swings.

As the position before opening the opening of the umbrella bag 1, the opening plate 210 is tilted so that a bottom side thereof pivotally supported on the end-side hinge 238 is located above and the end 210A side thereof abutting against the umbrella bag 1 is located below. The end-side torsion spring 239 biases the opening plate 210 clockwise in FIG. 4B so that the end 210A of the opening plate 210 approaches the umbrella bag 1.

Next, the bag opening operation of the bag opening device 200 will be described with reference to FIGS. 4 and 5. As illustrated in FIG. 4B, in the state before bag opening, the end 210A is pressed against the top end of the slide area S of the umbrella bag 1 (the location where the end 210A of the opening plate 210 abuts against is the top end of the slide area S of the umbrella bag 1). Here, since the first engagement portion 40 of the foremost umbrella bag 1 is covered by the front-side holding plate 120 of the holding structure 100, the end 210A of the opening plate 210 does not interfere with the first engagement portion 40. As a result, the first engagement portion 40 will not be broken by the opening plate 210.

Figure 5A:
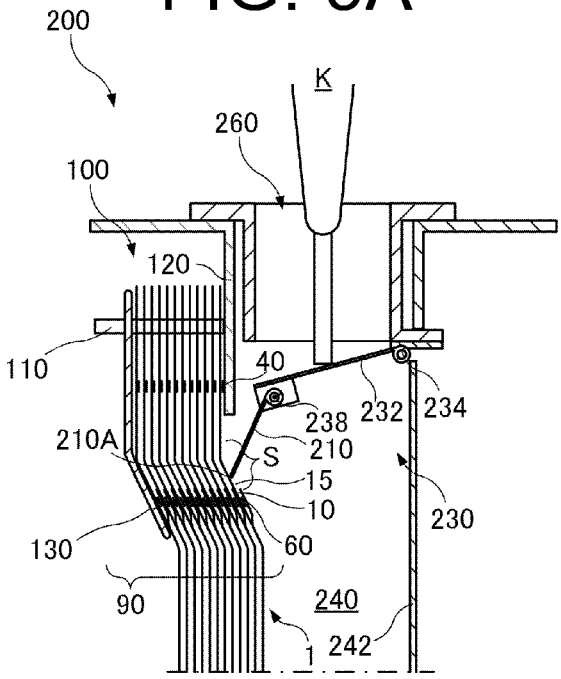
FIGS. 5A to 5C are enlarged cross-sectional side views of the bag opening device.
Figure 5B:
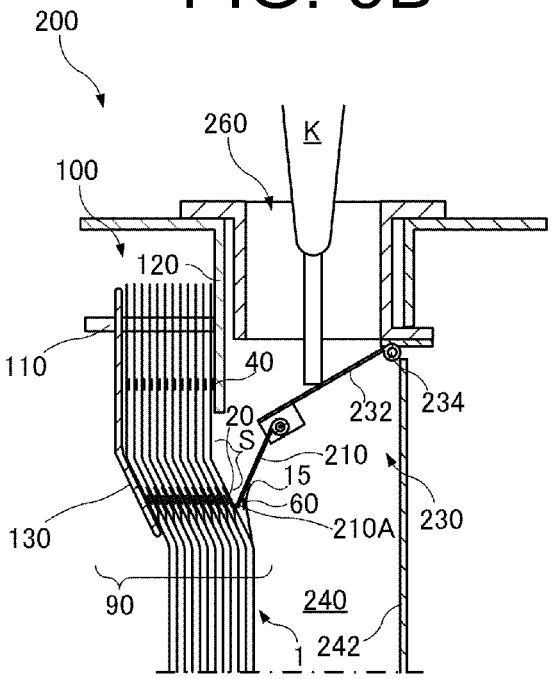

As illustrated in FIG. 5A, when the swing plate 232 of the moving mechanism 230 is pushed down by the ferrule of the umbrella K, the umbrella insertion port 260 opens and, at the same time, the end 210A of the opening plate 210 slides down the slide area S of the umbrella K. When the swing plate 232 is further pushed down by the umbrella K, as illustrated in FIG. 5B, the end 210A of the opening plate 210 enters the opening 15 of the umbrella bag 1. Here, the end 210A comes into between the second engagement portion 60 and the second bag portion 20.

Figure 5C:
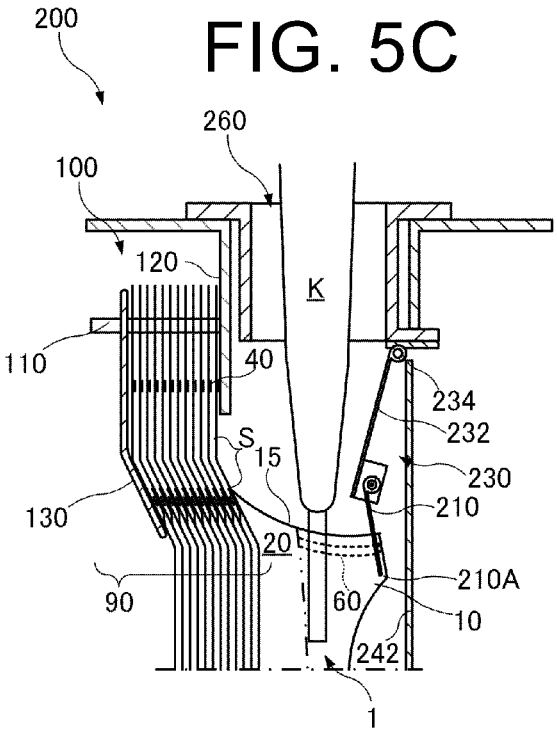

As illustrated in FIG. 5C, when the swing plate 232 is further pushed down by the umbrella K, the end 210A of the opening plate 210 moves in a direction away from the umbrella bag bundle 90, i.e., to the guide surface 242 side in the umbrella insertion space 240. As a result, the vicinity of the center between the first bag portion 10 and the second engagement portion 60 in the width direction is drawn to a front side away from the second bag portion 20. It follows that the opening 15 opens widely and, at the same time, the end of the umbrella K is inserted into the opening 15. The user then pushes in the umbrella K downward, whereby the canopy of the umbrella K is accommodated into the bag structure of the umbrella bag 1. The umbrella K is then taken out of the slit 240A in the width direction, whereby the umbrella bag 1 is torn off at the separation line 30A to enter the state of FIG. 2.

MODIFIED EXAMPLES

Figure 6A:
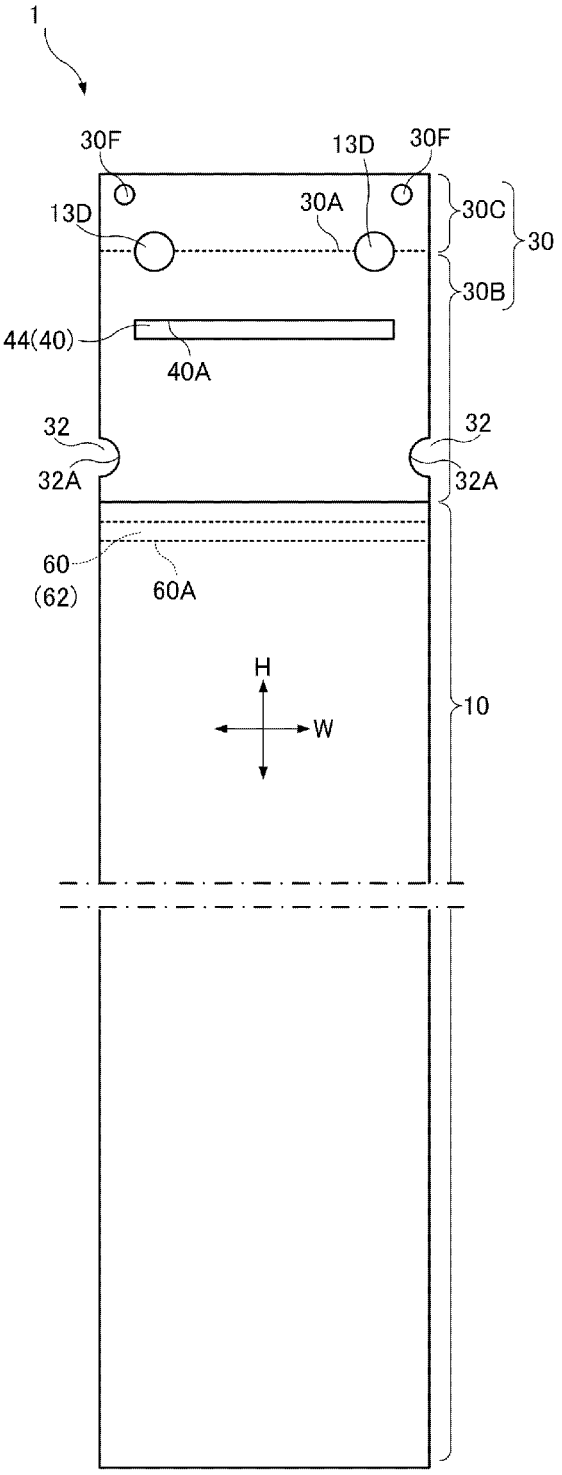
FIGS. 6A and 6B are a front view and a cross-sectional side view, respectively, illustrating a modified example of the umbrella bag.
Figure 6B:
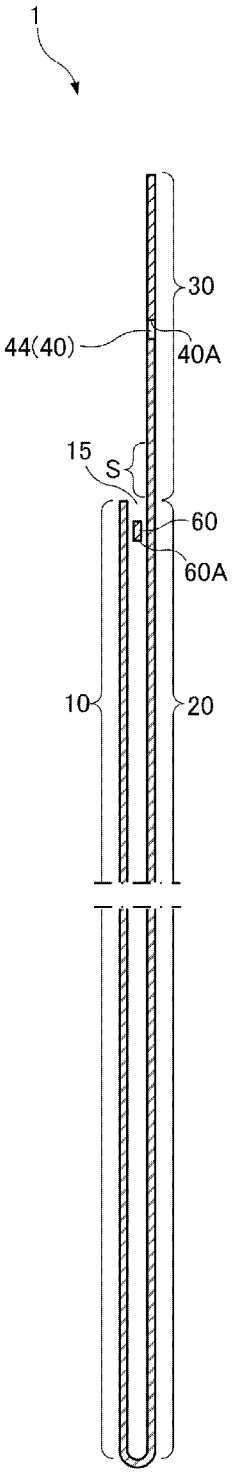

The umbrella bag 1 according to the foregoing embodiment is described to have the belt-like member 42 of the first engagement portion 40 located to overlap the extension 30. However, the present invention is not limited thereto. For example, as illustrated in FIGS. 6A and 6B, a slit or opening 44 extending in the width direction may be formed in the extension 30, and this opening 44 may be used as the first engagement portion 40. In such a case, the upper edge of the opening 44 serves as the engagement edge 40A capable of vertical engagement with the umbrella K.

Figure 7A:
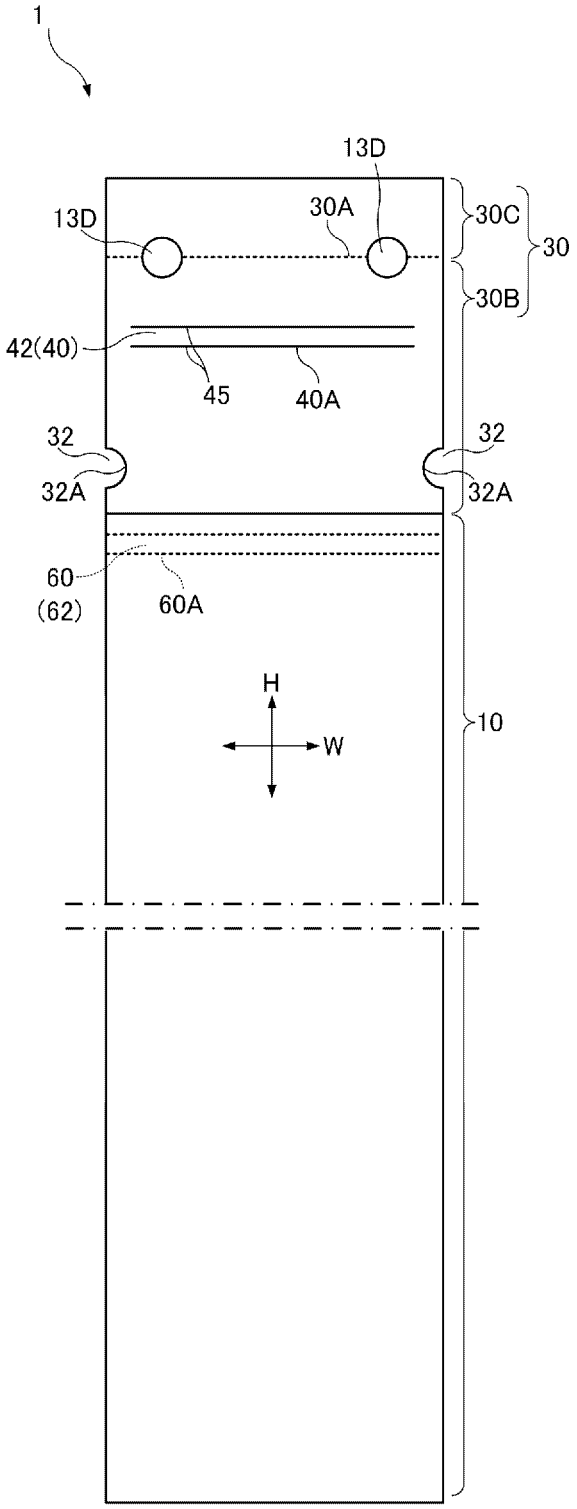
FIGS. 7A and 7B are a front view and a cross-sectional side view, respectively, illustrating a modified example of the umbrella bag.
Figure 7B:
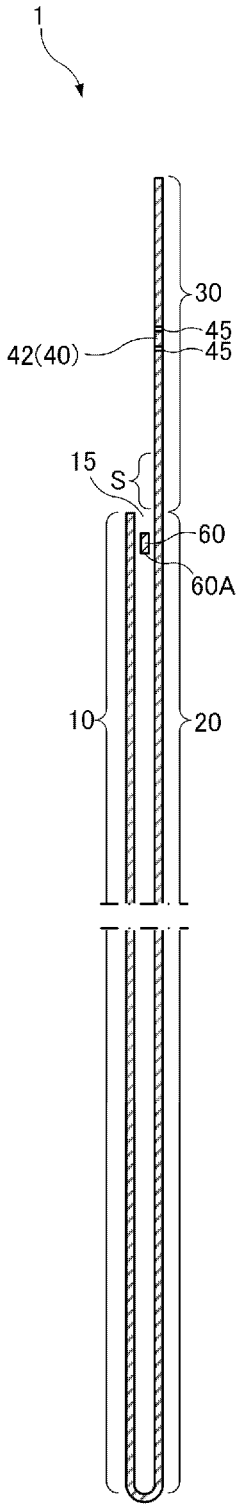

Moreover, for example, as illustrated in FIGS. 7A and 7B, a pair of mutually parallel slits 45 extending in the width direction may be formed in the extension 30, and the belt-like area between the pair of slits 45 may be used as the belt-like member 42 (first engagement portion 40). In such a case, the lower slit 45 serves as the engagement edge 40A capable of vertical engagement with the umbrella K.

Figure 8A:
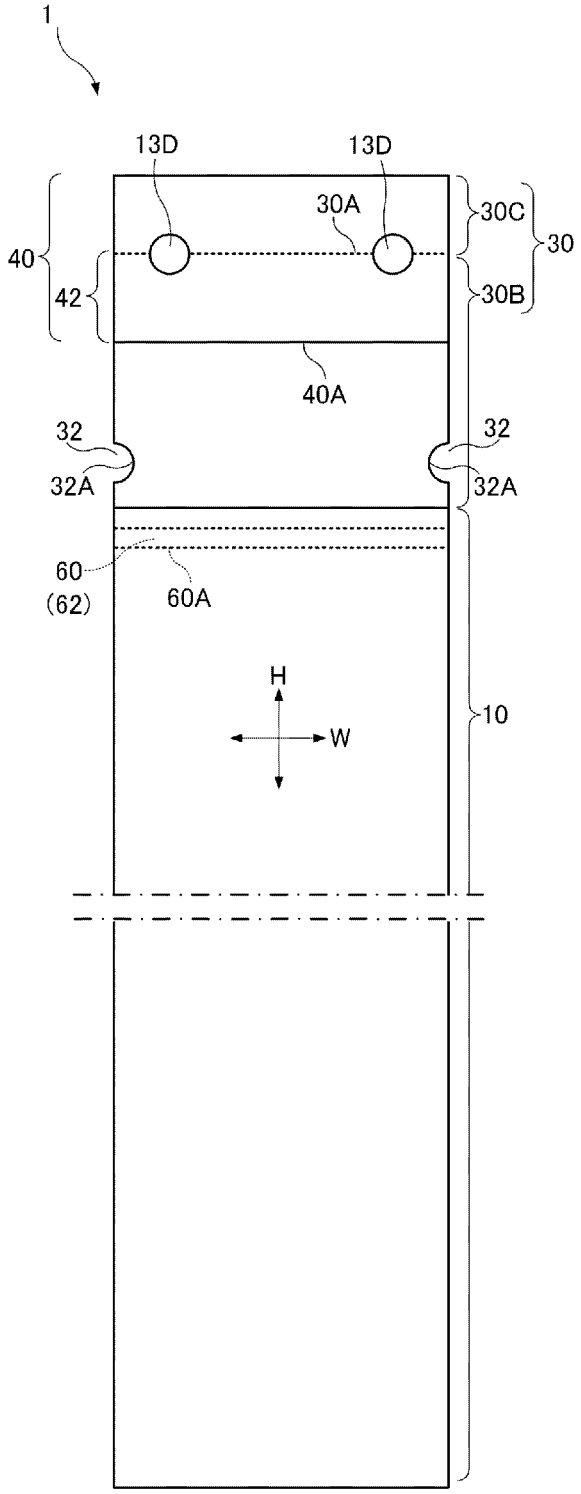
FIGS. 8A and 8B are a front view and a cross-sectional side view, respectively, illustrating a modified example of the umbrella bag.
Figure 8B:
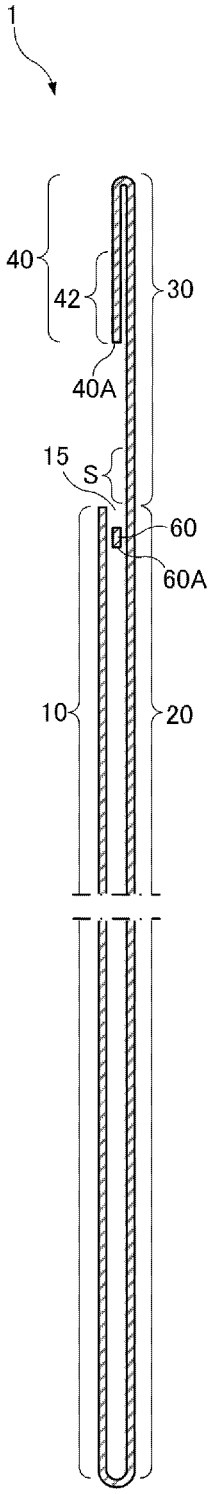

Furthermore, for example, as illustrated in FIGS. 8A and 8B, the top end of the extension 30 may be folded back to the front side to form a double structure, and the front-side sheet may be used as the first engagement portion 40. Both edges of the first engagement portion 40 in the width direction are joined to the extension 30. In other words, the belt-like member of the first engagement portion 40 may be increased in width, and the top end may be joined to near the top end of the extension 30. In such a case, the separation line 30A and the engagement holes 30F are also formed on the first engagement portion 40 side. When the first engagement portion 40 is separated at the separation line 30A, the belt-like member 42 is produced at the top end of the umbrella bag 1.

Figure 9A:
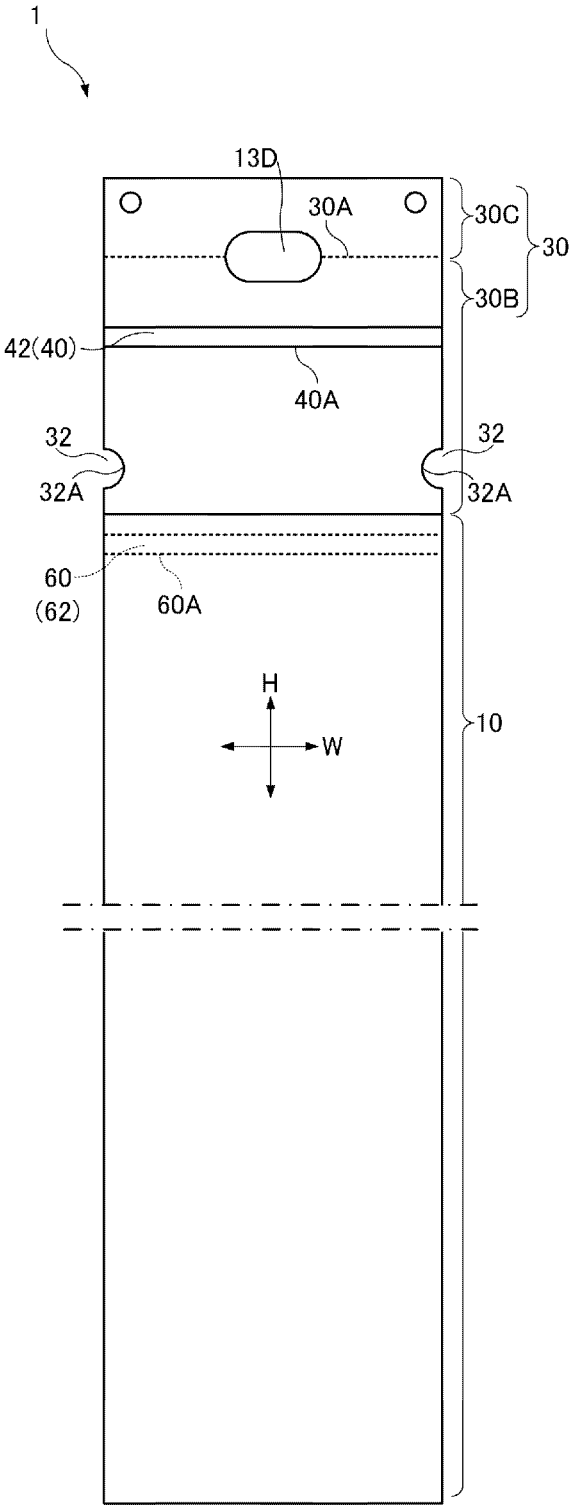
FIGS. 9A and 9B are a front view and a cross-sectional side view, respectively, illustrating a modified example of the umbrella bag.
Figure 9B:
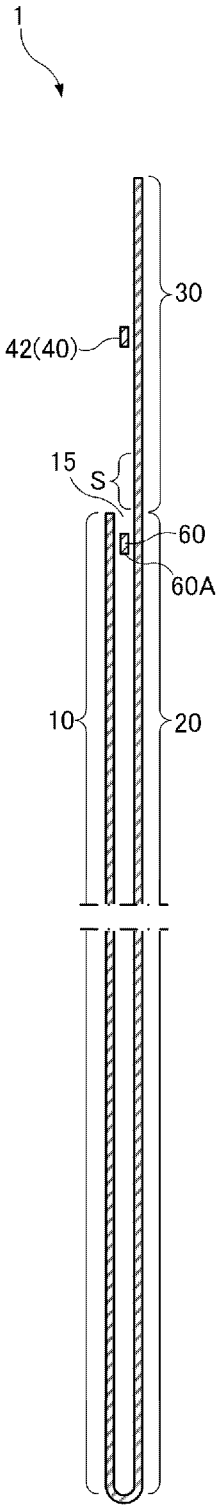

Furthermore, the foregoing embodiment has dealt with the case where two engagement holes 30F are formed. However, the present invention is not limited thereto. As illustrated in FIGS. 9A and 9B, an engagement hole F may be formed in the center in the width direction. Here, the engagement hole 30F is preferably formed as a long hole that is long in the width direction. This stabilizes the holding position of the umbrella bag bundle 90 when the umbrella bag bundle 90 is held by the holding mechanism 100.

It will be understood that the present invention is not limited to the foregoing embodiment, and various modifications can be made without departing from the gist of the present invention.

The invention claimed is:

1. An umbrella bag bundle including bundled umbrella bags each configured to accommodate an umbrella in a bag structure, wherein when a longitudinal direction of the umbrella accommodated in the bag structure is defined as a vertical direction and a direction orthogonal to the vertical direction is defined as a width direction, the umbrella bag includes:

a sheet-like first bag portion;

a sheet-like second bag portion that is opposed to the first bag portion and constitutes the bag structure having an opening at a top end in the vertical direction in cooperation with the first bag portion;

a sheet-like extension that is extended further upward from a top end of the second bag portion, the extension including:

a perforation configured to separate an upper part of the extension from a lower part of the extension extending from the second bag portion; and an arc-shaped cutout that is formed inwardly from a side edge of the extension in the width direction;

an engagement portion that is located on the extension and configured to engage with the umbrella to suppress falling of the umbrella bag from the umbrella, wherein the arc-shaped cutout is located between the perforation and the top end of the second bag portion in the vertical direction, and the engagement portion is located on the extension at a position shifted from the arc-shaped cutout in the vertical direction.

2. The umbrella bag bundle according to claim 1, further comprising:

a lower engagement portion that is located below and spaced apart from the engagement portion in the vertical direction, the lower engagement portion being configured to engage with the umbrella to suppress falling of the umbrella bag from the umbrella.

3. An umbrella bag bundle including bundled umbrella bags each configured to accommodate an umbrella in a bag structure, wherein when a longitudinal direction of the umbrella accommodated in the bag structure is defined as a vertical direction and a direction orthogonal to the vertical direction is defined as a width direction, the umbrella bag includes:

a sheet-like first bag portion;

a sheet-like second bag portion that is opposed to the first bag portion and constitutes the bag structure having an opening at a top end in the vertical direction in cooperation with the first bag portion;

a sheet-like extension that is extended further upward from a top end of the second bag portion;

an engagement portion that is located on the extension, the engagement portion being configured to engage with the umbrella to suppress falling of the umbrella bag from the umbrella; and a lower engagement portion that is located below and spaced apart from the engagement portion in the vertical direction, the lower engagement portion being configured to engage with the umbrella to suppress falling of the umbrella bag from the umbrella.

4. The umbrella bag bundle according to claim 3, wherein the lower engagement portion is located near the opening of the bag structure.

5. The umbrella bag bundle according to claim 4, wherein the lower engagement portion is located inside a bag of the bag structure.

6. The umbrella bag bundle according to claim 5, wherein the lower engagement portion is a belt-like member extending in the width direction.

7. The umbrella bag bundle according to claim 4, wherein the lower engagement portion is a belt-like member extending in the width direction.

8. The umbrella bag bundle according to claim 3, wherein the lower engagement portion is located inside a bag of the bag structure.

9. The umbrella bag bundle according to claim 8, wherein the lower engagement portion is a belt-like member extending in the width direction.

10. The umbrella bag bundle according to claim 3, wherein the lower engagement portion is a belt-like member extending in the width direction.

11. The umbrella bag bundle according to claim 3, wherein the extension includes:

a perforation configured to separate an upper part of the extension from a lower part of the extension extending from the second bag portion; and an arc-shaped cutout that is formed inwardly from a side edge of the extension in the width direction, the arc-shaped cutout is located between the perforation and the top end of the second bag portion in the vertical direction, and the engagement portion is located on the extension at a position shifted from the arc-shaped cutout in the vertical direction.

12. A holding structure for an umbrella bag bundle including bundled umbrella bags each configured to accommodate an umbrella in a bag structure, wherein when a longitudinal direction of the umbrella accommodated in the bag structure is defined as a vertical direction and a direction orthogonal to the vertical direction is defined as a width direction, the umbrella bag in the umbrella bag bundle includes:

a sheet-like first bag portion;

a sheet-like second bag portion that is opposed to the first bag portion and constitutes the bag structure having an opening at a top end in the vertical direction in cooperation with the first bag portion;

a sheet-like extension that is extended further upward from a top end of the second bag portion;

an engagement portion that is located on the extension, the engagement portion being configured to engage with the umbrella to suppress falling of the umbrella bag from the umbrella; and a lower engagement portion that is located below and spaced apart from the engagement portion in the vertical direction, the lower engagement portion being configured to engage with the umbrella to suppress falling of the umbrella bag from the umbrella, the holding structure includes a holding plate configured to abut against a flat surface of the extension on a side closer to the first bag portion, and the holding plate is located above the opening and covers the engagement portion.

13. The holding structure according to claim 12, wherein the extension includes:

a perforation configured to separate an upper part of the extension from a lower part of the extension extending from the second bag portion; and an arc-shaped cutout that is formed inwardly from a side edge of the extension in the width direction, the arc-shaped cutout is located between the perforation and the top end of the second bag portion in the vertical direction, and the engagement portion is located on the extension at a position shifted from the arc-shaped cutout in the vertical direction.

14. A bag opening device configured to open an opening of an umbrella bag in an umbrella bag bundle including bundled umbrella bags each configured to accommodate an umbrella in a bag structure, wherein when a longitudinal direction of the umbrella accommodated in the bag structure is defined as a vertical direction and a direction orthogonal to the vertical direction is defined as a width direction, the umbrella bag in the umbrella bag bundle includes:

a sheet-like first bag portion;

a sheet-like second bag portion that is opposed to the first bag portion and constitutes the bag structure having the opening at a top end in the vertical direction in cooperation with the first bag portion;

a sheet-like extension that is extended further upward from a top end of the second bag portion;

an engagement portion that is located on the extension, the engagement portion being configured to engage with the umbrella to suppress falling of the umbrella bag from the umbrella; and a lower engagement portion that is located below and spaced apart from the engagement portion in the vertical direction, the lower engagement portion being configured to engage with the umbrella to suppress falling of the umbrella bag from the umbrella, the bag opening device further comprises:

a holding structure configured to hold the umbrella bag bundle;

an opening plate that is to be inserted into the opening to open the opening; and a moving mechanism configured to bring an end of the opening plate into contact with the extension above the opening and below the engagement portion and slide the end of the opening plate up to the opening.

15. The bag opening device according to claim 14, wherein the extension includes:

a perforation configured to separate an upper part of the extension from a lower part of the extension extending from the second bag portion; and an arc-shaped cutout that is formed inwardly from a side edge of the extension in the width direction, the arc-shaped cutout is located between the perforation and the top end of the second bag portion in the vertical direction, and the engagement portion is located on the extension at a position shifted from the arc-shaped cutout in the vertical direction.

* * * * *